United States Patent [19]

Brown et al.

[11] Patent Number: 4,477,071

[45] Date of Patent: Oct. 16, 1984

[54] CONVERTIBLE ROWING EXERCISING APPARATUS

[75] Inventors: Peter L. Brown, Chelmsford; Patrick C. Fitzpatrick; Frederick W. Lloyd, both of Harlow, all of England

[73] Assignee: Bodytone Limited, Hertfordshire, England

[21] Appl. No.: 475,189

[22] Filed: Mar. 14, 1983

[30] Foreign Application Priority Data

May 25, 1982 [GB] United Kingdom ..... 8215026

[51] Int. Cl.[3] ..... A63B 21/00; A63B 69/06

[52] U.S. Cl. ..... 272/72; 272/130; 272/134

[58] Field of Search ..... 272/130, 134, 72, 145, 272/144, 73, 132, 135

[56] References Cited

U.S. PATENT DOCUMENTS

| | | | |
|---|---|---|---|
| D. 263,978 | 4/1982 | Brentham | 272/134 |
| 432,598 | 7/1890 | Bryon | 272/72 |
| 1,801,223 | 4/1931 | Clausen | 272/132 |
| 2,209,034 | 7/1940 | Paul | 272/73 |
| 3,173,415 | 3/1965 | Rubin | 272/144 |
| 3,473,843 | 10/1969 | Hart | 297/130 |
| 3,586,322 | 6/1971 | Kvernland | 272/142 X |
| 3,892,404 | 7/1975 | Martucci | 272/79 |
| 4,240,627 | 12/1980 | Brentham | 272/134 |
| 4,275,882 | 6/1981 | Grosser | 272/130 |
| 4,319,747 | 3/1982 | Rogers | 272/73 |
| 4,372,551 | 2/1983 | Yurdin | 272/73 |

FOREIGN PATENT DOCUMENTS

| | | |
|---|---|---|
| 438128 | 11/1935 | United Kingdom . |
| 1101009 | 1/1968 | United Kingdom . |
| 1326263 | 8/1973 | United Kingdom . |

OTHER PUBLICATIONS

Sears Roebuck Fall and Winter 1980 Catalog, p. 560.

Americ 610 and 660 Rowing Machines, advertizing brochure of Amerec, Bellevue, WA, 3/82.

*Primary Examiner*—Richard J. Johnson

*Attorney, Agent, or Firm*—Banner, Birch, McKie & Beckett

[57] ABSTRACT

A physical exercising apparatus having at least one force-resistive, movable handle. Two generally perpendicular user supports enable the apparatus to be used in two different positions so as to increase the range of exercises which can be performed.

20 Claims, 14 Drawing Figures

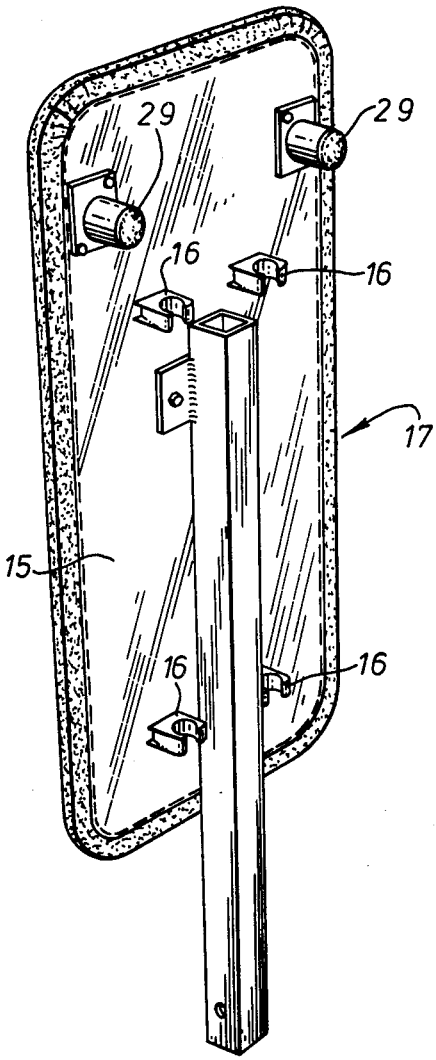
FIG. 4.
FIG. 5.
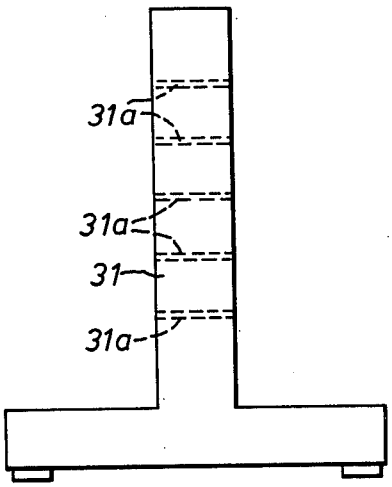

CONVERTIBLE ROWING EXERCISING APPARATUS

BACKGROUND OF THE INVENTION

The invention relates to physical exercising apparatus and more particularly, to exercising apparatus which affords a wide range of exercises.

Exercising apparatus of the nature of gymnasium equipment is well known and increasingly is being used privately in domestic homes. Up until now, however, to accommodate the wide variety of different exercises consistent with a balanced program of exercise it is necessary to use different items of exercising apparatus. Especially in the domestic situation the expense and bulk of the various different pieces of apparatus required to give a reasonably comprehensive program of exercises has militated against such home use. The same drawbacks also apply to most of the more versatile (multi-exercise) units designed for the home.

SUMMARY OF THE INVENTION

It is, therefore, an object of the invention to provide a simple and compact exercising apparatus which is adaptable so that a range of different exercises including rowing exercises are possible with one machine.

This and other objects of the invention are accomplished by providing a ground-supported physical exercising apparatus comprising a generally horizontal frame, at least one pivoted movable lever operatively connected to the frame and having a handle adapted to be grasped and moved by a user, and resistance means operatively coupled to the level for providing resistance to movement of the level. A longitudinal track on the frame slidably carries a first user support in the form of a seat, and foot bracing means on the frame allows the user to brace his feet. A second user support is secured to the frame generally perpendicular to the track. Ground-engaging auxiliary support means supports the apparatus with the frame in an upright position. In this way the apparatus can readily be converted from a rowing machine to fulfill different functions such as push-up, press-up and sit-up exercises.

The second user support is preferably in the form of a bench and preferably ground engaging members are provided on the undersurface of the bench. If desired means may be provided on the bench whereby it can be detachably mounted on the sliding seat track.

BRIEF DESCRIPTION OF THE DRAWINGS

The invention is diagrammatically illustrated, by way of example, in the accompanying drawings in which:

FIG. 4 is a bottom perspective view of a bench member;

FIG. 5 is a front elevational view of an adjustable ground engaging member, by means of which the apparatus can be inclined.

DETAILED DESCRIPTION

Figure 1:
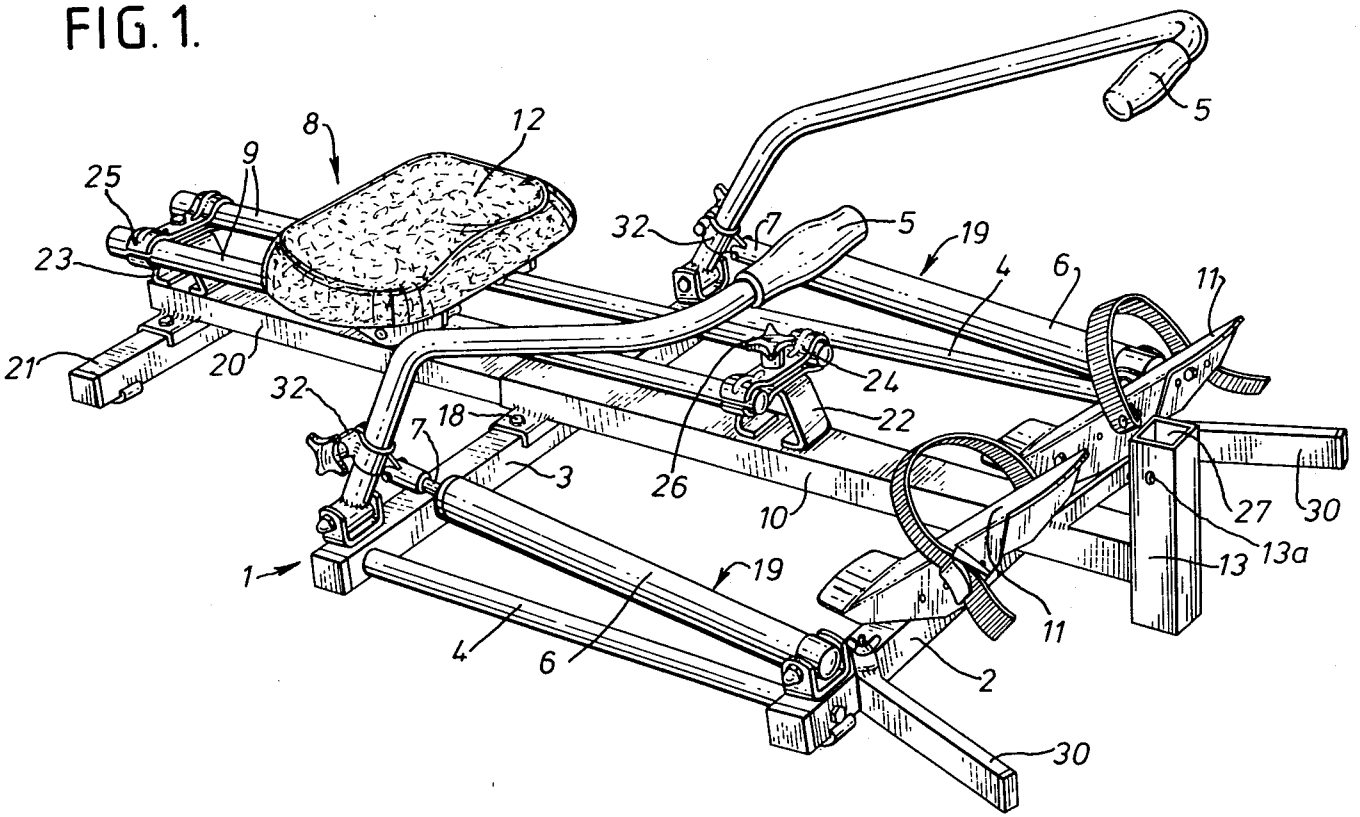
FIG. 1 is a perspective view of physical exercising apparatus adapted for use as a rowing machine.

In the drawings physical exercising apparatus according to the invention comprises a generally rectangular framework 1 having a pair of square-section bars 2 and 3 respectively interconnected near their ends by a pair of round-second bars 4. A pair of levers formed at their free or distal ends with handles 5 are pivotally mounted on the bar 3 near to the opposite ends thereof and the levers are connected to the piston rods 7 of a pair of hydraulic dampers 19, the cylinders 6 of which are pivotally mounted on the bar 2 near to the opposite ends thereof. The connection between the levers and the piston rods are by means of manually adjustable clamps 32 and thus the position at which the piston rod engages the lever can be varied to alter the effort required to move the handles.

The unit described above forms the basic assembly of the exercising apparatus and is capable of use in this basic form, for example when mounted on a wall. Heavier as shown in FIG. 1, a rowing attachment generally indicated at 8 is detachably secured to the bars 2 and 3 of the rectangular framework 1, e.g. by bolts 18. The rowing attachment comprises a square-sectioned tubular main beam 10 mounted on the bars 2 and 3. The tubular main beam 10 telescopically receives a square-sectioned extension beam 20, the free end of which carries a ground engaging foot 21, A pedestal 22 is secured on the upper surface of the main beam 10 and a corresponding pedestal 23 is secured on the upper surface of the extension beam 20 at its free end. The pedestals 22 and 23 are formed with respective clamps 24 and 25 which carry a parallel pair of rails 9 for a sliding seat 12. The distance by which the extension beam 20 projects from the main beam 10 can be altered from the fully extended position shown in FIG. 1 to the fully retracted position shown in FIG. 3 by releasing the clamp 24 by means of a knob 26 so that the rails 9 can be slid relative to the clamp 24.

Figure 2:
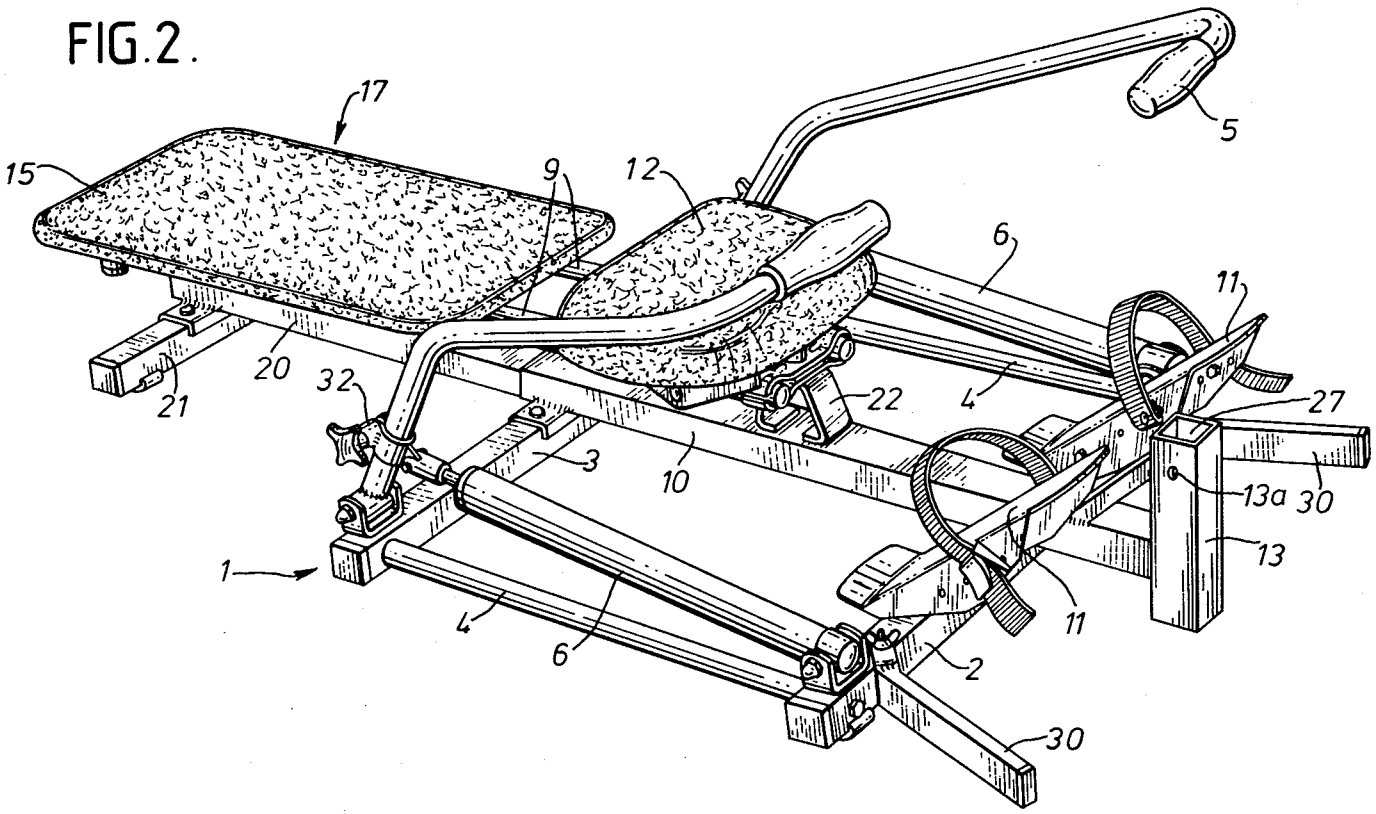
FIG. 2 is a perspective view of the apparatus of FIG. 1, and showing the apparatus adapted for exercise with the user supine.
Figure 3:
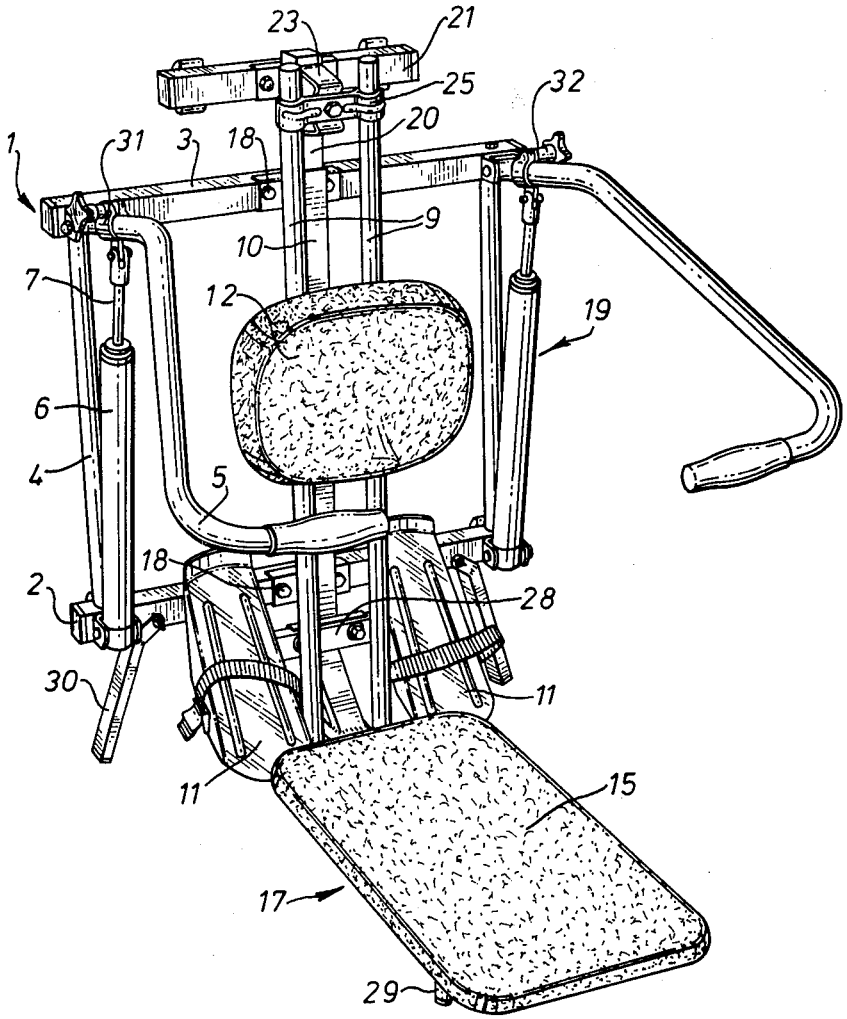
FIG. 3 is a perspective view of the apparatus of FIGS. 1 and 2, and showing the apparatus in a third operative condition.
Figure 6A:
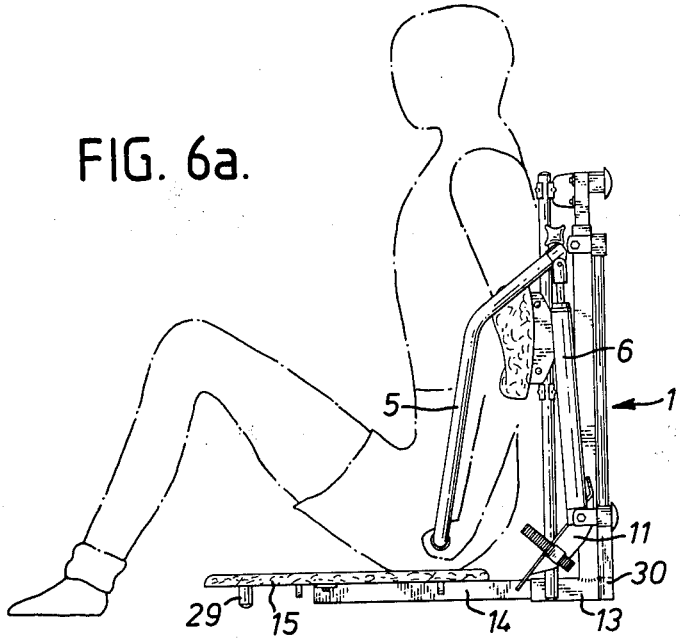
FIGS. 6*a* to 6*i* show nine different exercises which can be performed using the apparatus of FIGS. 1 to 4.
Figure 6B:
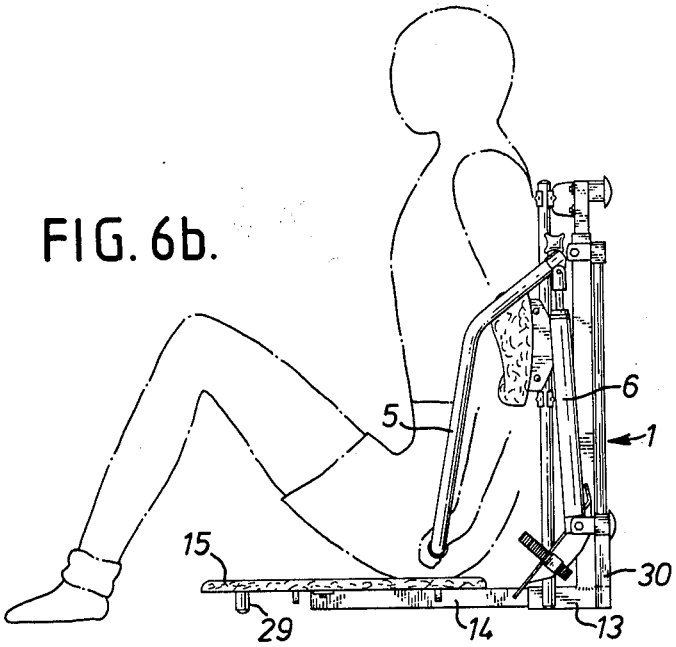
Figure 6C:
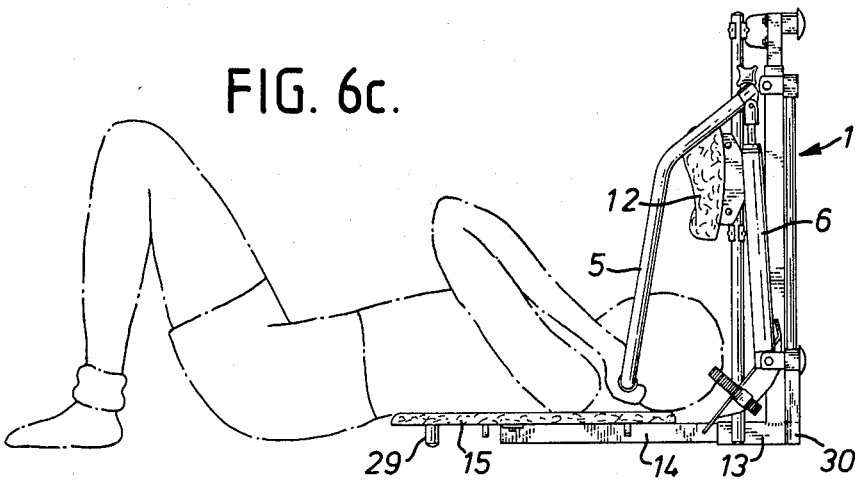
Figure 6D:
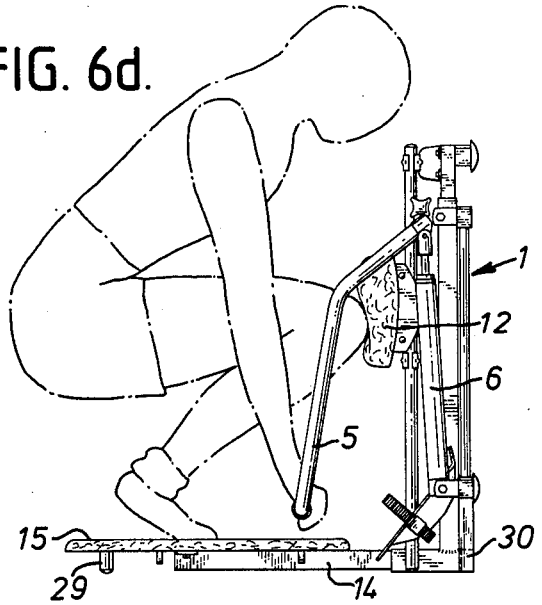
Figure 6E:
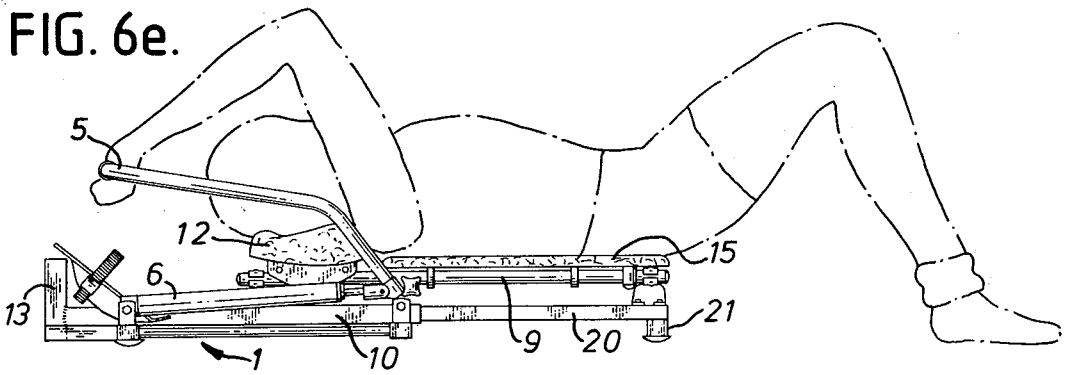
Figure 6F:
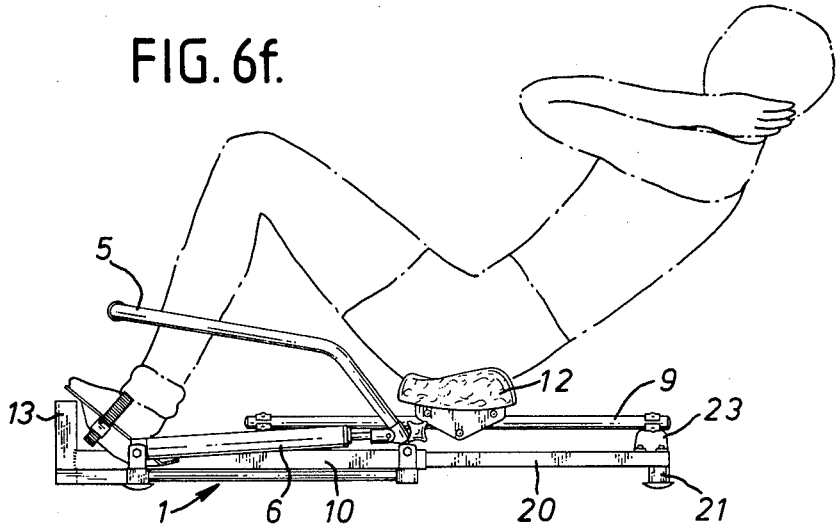
Figure 6G:
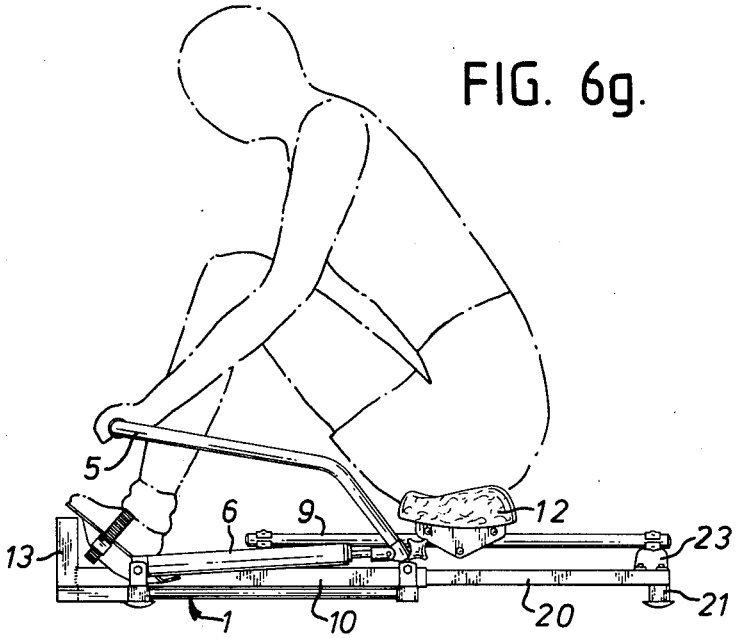
Figure 6H:
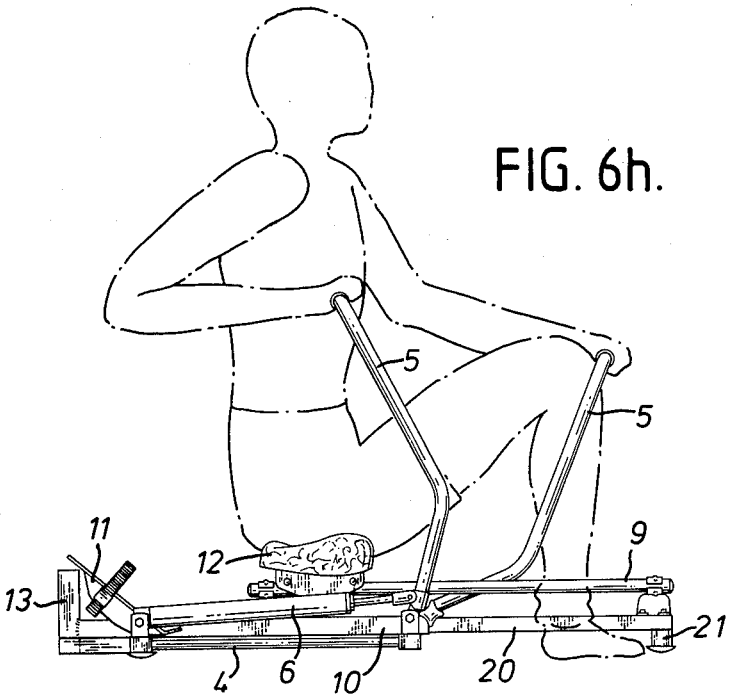

Also mounted on the beam 10 is a crosspiece 28, best seen in FIG. 3, which carries a pair of footrests 11. A socket member 13 (FIGS. 1, 2) is secured to the end of the main beam 10 remote from the extension beam 20 and is arranged with its socket 27 extending generally at right angles to the main beam 10. Socket member 13 has a pair of aligned holes 13*a*. The socket member 13 is arranged to support a bench member 17 which comprises a beam 14 of square cross-section having secured thereto, e.g. by screws, a bench 15. A through hole 14*a* near the end of beam 14 enables bench 17 to be securely pinned or bolted to socket member 13 through holes 13*a*. Thus, when the end of the beam 14 is mounted in the socket 27 in the member 13, the bench 15 extends generally at right angles to the main beam 10 whereby the apparatus can be up-ended as shown in FIG. 3 for use for performing the exercises of FIGS. 6*a* to 6*d*, and supported partly on feet 29 on the underside of the bench and partly on foldable feet 30 mounted on the bar 2 of the frame 1. Clips 16 (FIG. 4) are provided on the underside of the bench 15 so that the bench can be supported on the rails 9 as shown in FIG. 2 to enable the apparatus user to perform the exercise shown in FIG. 6*e*.

Figure 6I:
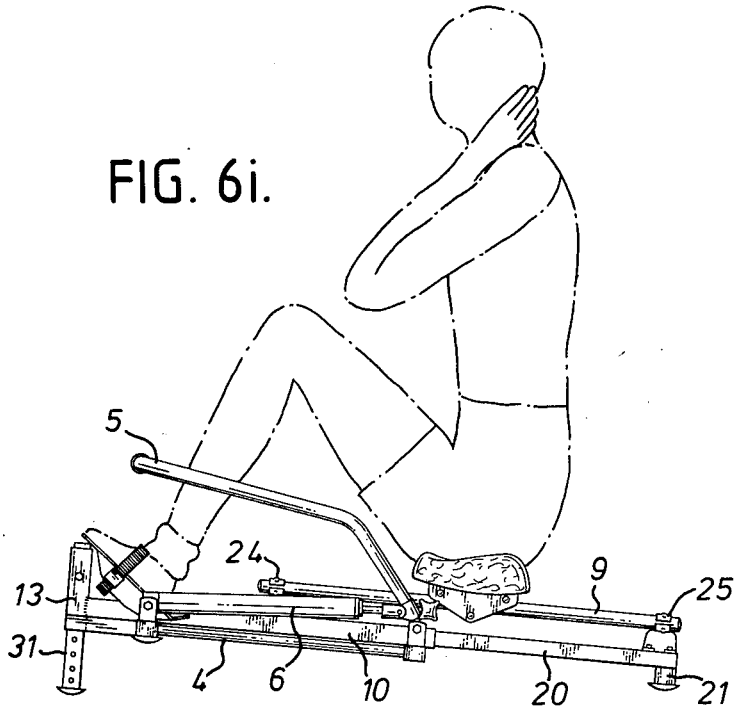

A ground-engaging member 31 shaped as an inverted T and having a plurality of holes 31*a* as shown in FIG. 5 may be positioned and adjustably pinned in the socket 27 in the member 13 so that the apparatus can be inclined as shown in FIG. 6*i*.

Since the crosspiece 28 carrying the footrests 11 is removably secured by bolts to the main beam 10, the footrests can be removed from the position shown in FIG. 1 and secured to the free end of the extension beam 20. If the bench 15 is then placed on the rails 9 as shown in FIG. 2, the apparatus can be used to perform a range of exercises in which the handles 5 are pushed instead of being pulled.

It will be appreciated that the exercises shown in FIGS. *6a* to *6i* are only examples of those which can be performed with the apparatus of the invention. In FIGS. *6a* to *6d* the apparatus is in the condition shown in FIG. 3 and the exercises illustrated are respectively push-ups from a sitting position; pull-ups from a sitting position; press-ups from a lying position, and a squatting to standing exercise. In FIG. *6e* the apparatus is in the condition shown in FIG. 2 and the exercise shown involves overhead pull-ups from a supine position. In FIGS. *6f* to *6i* the apparatus is in the condition shown in FIG. 1, that is to say the rowing condition, and the exercises are respectively a sit-up exercise; a rowing exercise; a pushing exercise; and a sit-up exercise with the apparatus inclined.

It is to be understood that the above described apparatus is but one example of the invention. It will be apparent to one of ordinary skill that modifications and changes may be made in the structure of the invention without departing from the true spirit and scope of the invention, which is defined by the appended claims.

We claim:

1. A ground-supported physical exercising apparatus capable of use in any of a plurality of orientations, and adapted to be selectively used as a rowing machine or for performing other types of exercises, comprising:

a generally horizontal frame;

at least one pivoted movable lever operatively connected to said frame and having a handle adapted to be grasped and moved by a user's hand;

resistance means operatively coupled to said lever for providing resistance to the movement of said lever;

a longitudinal track attached to said frame;

a first user support comprising a seat slidable along said track;

foot bracing means for bracing the user's feet;

ground-engaging auxiliary support means for stably supporting the apparatus with said frame in an upright position;

a second user support; and attaching means for firmly attaching said second user support to the apparatus adjacent the lower end of and generally perpendicular to said upright frame so that the user can grasp and move said handle while supported on said second user support, thereby increasing the range of exercises which can be performed with the apparatus.

2. Physical exercising apparatus according to claim 1 wherein said frame is adjustable in length.

3. Physical exercising apparatus according to claim 2 wherein said frame includes a longitudinal member comprising two telescoping portions.

4. Physical exercising apparatus according to claim 3 wherein said frame comprises a support foot at the distal end of each telescoping portion, one of said support feet being extensible to vary the angle of inclination of said frame.

5. Physical exercising apparatus according to claim 1 wherein said auxiliary support means includes ground-engaging means on the underside of said second user support, whereby said second user support serves to support said frame when said frame is in its upright position.

6. Physical exercising apparatus according to claim 5 wherein said auxiliary support means includes ground-engaging means on said frame.

7. Physical exercising apparatus according to claim 5 wherein said attaching means comprises coupling means for detachably coupling said second user support to said frame.

8. Physical exercising apparatus according to claim 7 wherein said frame includes a longitudinal member, and said coupling means couples one end of said second user support to one end of said longitudinal member.

9. Physical exercising apparatus according to claim 8 wherein said coupling means comprises cooperating male and female coupling elements at said ends of said second user support and said longitudinal member.

10. Physical exercising apparatus according to claim 9 wherein said coupling means comprises a socket at one end of and generally perpendicular to said longitudinal member, and a projecting beam at one end of said second user support adapted to be received in said socket.

11. Physical exercising apparatus according to claim 8 wherein said longitudinal member is adjustable in length.

12. Physical exercising apparatus according to claim 11 wherein said longitudinal member comprises two telescoping portions.

13. Physical exercising apparatus according to claim 7 wherein said second user support comprises a bench.

14. Physical exercising apparatus according to claim 1 wherein said attaching means comprises coupling means for detachably coupling said second user support to said frame.

15. Physical exercising apparatus according to claim 14 further comprising track mounting means on the underside of said second user support for mounting said second user support on said track.

16. Physical exercising apparatus comprising:

a frame including a longitudinal member adjustable in length;

two levers pivoted to said frame on opposite sides of said longitudinal member, each of said levers having a handle at its distal end adapted to be grasped and moved by a user;

a fluid cylinder interconnecting said frame and an intermediate portion of each lever for providing resistance to the movement of the lever;

a track secured to said frame parallel to said longitudinal member;

a seat slidable along said track;

a pair of footrests on said frame on opposite sides of said longitudinal member for bracing the user's feet;

frame support means beneath said frame for supporting said frame in a generally horizontal position;

a bench removably coupled to said frame adjacent one end of said longitudinal member generally perpendicular to said longitudinal member and said seat; and ground-engaging means on the underside of said bench, whereby said bench serves to support said frame in an upright position.

17. Physical exercising apparatus according to claim 16 further comprising track coupling means on the underside of said bench for coupling said bench to said track.

18. Physical exercising apparatus according to claim 17 wherein an end of said longitudinal member carries a socket generally perpendicular to said longitudinal member, and said bench includes a projecting beam at one end thereof adapted to be received in said socket.

19. Physical exercising apparatus according to claim 18 wherein said frame support means includes an extensible support foot adjacent one end of said longitudinal member for varying the angle of inclination of said frame.

20. Physical exercising apparatus according to claim 19 wherein each of said fluid cylinders is adjustably coupled to the intermediate portion of the lever to selectively vary the resistance to movement.

* * * * *

UNITED STATES PATENT AND TRADEMARK OFFICE

CERTIFICATE OF CORRECTION

PATENT NO. : 4,477,071

DATED : 10-16-84

INVENTOR(S) : Peter L. Brown et al.

It is certified that error appears in the above—identified patent and that said Letters Patent is hereby corrected as shown below: On the title page;

In [30] Foreign Application Priority Data, delete "8215026" and insert --8215206--.

In [56] References Cited, Foreign Patent Documents, insert:

| | | |
|---|---|---|
| --126662 | 11-8-49 | Sweden |
| 1,081,419 | 12-20-54 | France-- |

Column 1, line 34, delete "level" and insert --lever--;

line 35, delete "level" and insert --lever--;

line 35, delete "on" and insert --attached to--;

line 37, delete "on the frame";

line 38, after "feet." insert --Ground-engaging auxiliary support means supports the apparatus with the frame in an upright position.--;

line 38, after "is" insert --firmly--;

UNITED STATES PATENT AND TRADEMARK OFFICE

CERTIFICATE OF CORRECTION

PATENT NO. : 4,477,071

DATED : 10-16-84

INVENTOR(S) : Peter L. Brown et al.

It is certified that error appears in the above—identified patent and that said Letters Patent is hereby corrected as shown below:

Column 1, line 39, delete "frame" and insert --apparatus--;

line 39, delete "the track" and insert --and adjacent the lower end of the upright frame--;

lines 40 and 41, delete "Ground-engaging auxiliary support means supports the apparatus with the frame in an upright position."

Column 2, line 21, delete "Heavier" and insert --However--.

Column 4, claim 16, lines 43 and 44, delete "adjustable in length".

Signed and Sealed this

*Twenty-ninth* Day of *October 1985*

[SEAL]

*Attest:*

*Attesting Officer*

DONALD J. QUIGG

*Commissioner of Patents and Trademarks—Designate*